United States Patent [19]

Wehr

[11] Patent Number: 4,952,371

[45] Date of Patent: Aug. 28, 1990

[54] VOLATILE LIQUID CATALYST HANDLING SYSTEM INCLUDING DISTIBUTION CABINET

[75] Inventor: Craig M. Wehr, Waterloo, Iowa

[73] Assignee: Deere & Company, Moline, Ill.

[21] Appl. No.: 380,409

[22] Filed: Jul. 17, 1989

[51] Int. Cl.[5] ..... G01N 31/10; B22D 11/16; B65B 1/30; B65B 31/04

[52] U.S. Cl. ..... 422/62; 141/21; 141/95; 141/192; 164/154; 312/211; 312/234; 312/236; 422/81; 422/104; 422/105; 422/106

[58] Field of Search ..... 422/62, 81, 105, 106, 422/103, 104, 50, 1; 164/16, 21, 154, 165, 169; 600/21; 312/31, 209, 211, 234; 141/21, 22, 37, 83, 94, 95, 192

[56] References Cited

U.S. PATENT DOCUMENTS

| | | | |
|---|---|---|---|
| 3,536,370 | 10/1970 | Evans et al. | 600/21 |
| 3,874,754 | 4/1975 | Saunders et al. | 312/209 |
| 4,304,224 | 12/1981 | Fortney | 422/104 |
| 4,483,384 | 11/1984 | Michel | 164/16 |
| 4,495,028 | 1/1985 | Rowe | 422/106 |
| 4,540,531 | 9/1985 | Moy | 164/16 |
| 4,852,621 | 8/1989 | Bear | 141/94 |

FOREIGN PATENT DOCUMENTS

| | | | |
|---|---|---|---|
| 0667821 | 11/1988 | Switzerland | 164/169 |

*Primary Examiner*—Robert J. Warden
*Assistant Examiner*—Kimberly A. Trautman

[57] ABSTRACT

A system for delivering liquid catalyst to a core-making machine includes a single fireproof cabinet in which is located a catalyst storage tank. The storage tank receives catalyst from catalyst supply drums that are positioned one at a time in a pumping station located in the cabinet beside the tank and emptied into the tank by a barrel pump. A flash-off station is located in the cabinet beside the pumping station for receiving emptied drums and an exhaust hose, that is coupled to a scrubber system exhaust duct, is positionable within the drum to carry away vapors produced in the drum as residual catalyst flashes off. A catalyst supply pump is coupled for pumping liquid catalyst from the storage tank to a gassing unit of a core-making machine. Excess catalyst is returned from the gassing unit to the storage tank by way of a water-cooled heat exchanger which cools the returning catalyst and hence that remaining in the tank so as to keep the catalyst at a temperature low enough to prevent its vaporization and thus the vapor locking of the supply pump.

7 Claims, 3 Drawing Sheets

Fig. 2
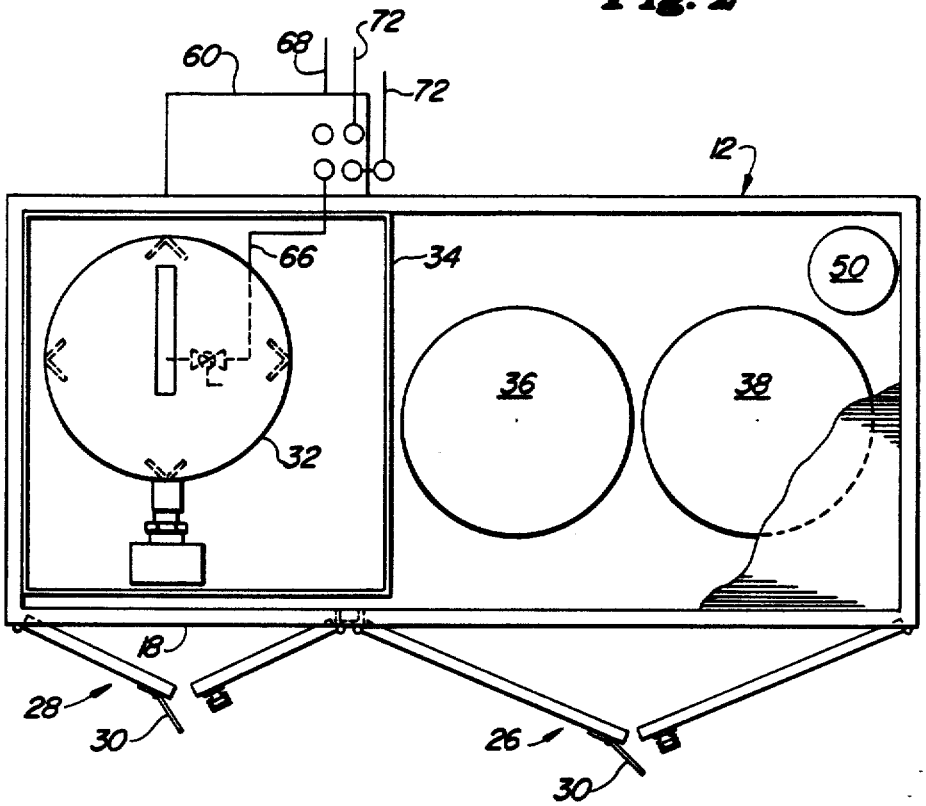
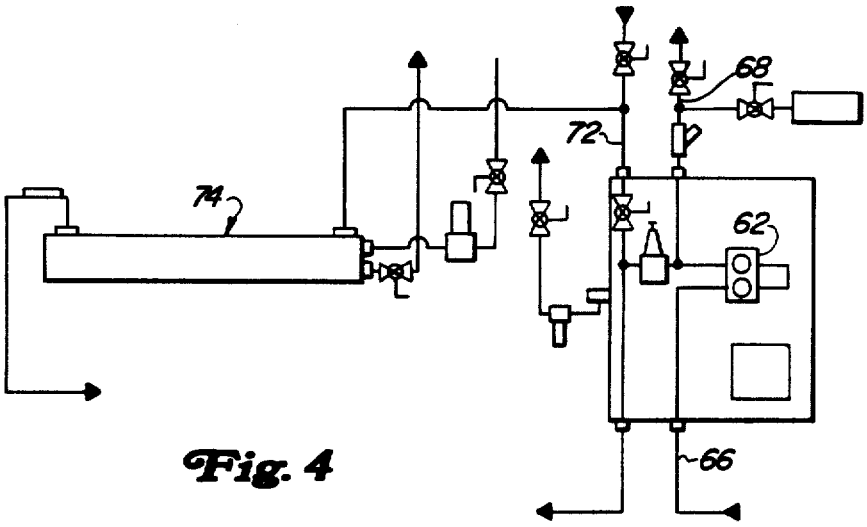
Fig. 4

VOLATILE LIQUID CATALYST HANDLING SYSTEM INCLUDING DISTIBUTION CABINET

BACKGROUND OF THE INVENTION

The present invention relates to a system for handling a volatile liquid used in a manufacturing process and more particularly relates to a system for handling a catalyst used in a foundry core making process.

The cold box core making process uses a liquid catalyst, such as dimethylethylamine (DMEA) or triethylamine (TEA), to cure cores during the production cycle. Specifically, resin coated sand is blown into a core box to form the desired shape. The liquid catalyst is pumped from a drum, typically of a forty-five or fifty-five gallon size, or a storage tank to each core machine where it is vaporized in a gassing station. The gas is then forced through the core by pressure so as to cure the resins coating the sand and thereby rigidify the core.

The catalysts commonly used are highly volatile and flammable and heretofore the known systems for supplying catalysts to core machines have not adequately addressed problems which result because of the characteristics of the catalysts.

Specifically, during the summer months temperatures often rise above the boiling point of the catalyst resulting in the catalyst vaporizing which causes the catalyst supply pump to become vapor locked Once this has happened, the pumping system has to be cooled before liquid can be pumped again. These delays in the production of molds can, especially in this era of just-in-time manufacturing procedures, result in delays in the production of machinery embodying the parts to be molded and hence can be quite costly.

In core making systems where the drums in which the catalyst is supplied is also used as the storage container from which the catalyst is pumped, the storage drums have to be changed before they are fully emptied of catalyst in order to avoid production delays Heretofore, the practice as been to keep these almost empty drums in storage until enough are on hand to make a full drum and then to manually pump the catalyst from the saved drums into a single drum. Unless properly stored, the almost empty drums represent a serious fire hazard. And even after this hand-pumping operation, sufficient residual catalyst is left in the drums that the drums cannot be sold or otherwise disposed of unless the residual catalyst is first flashed off by removing the drums from their storage area and transporting them to a special flash off cabinet. The transporting of these drums to the flash off cabinet is a dangerous operation because of the fire hazard involved.

The manual handling of the catalyst drums presents further hazards to those handling the drums since breathing of small amounts of vapors or contact with the catalyst can cause serious physical harm.

SUMMARY OF THE INVENTION

According to the present invention, there is provided an improved system for handling catalyst in a core-making process and more specifically to provide a system which avoids the aforementioned drawbacks associated with known catalyst handling systems.

An object of the invention is to provide a catalyst handling system including a cabinet containing a catalyst storage tank and having a pumping station for receiving a catalyst supply drum from which catalyst may be pumped to replenish the catalyst supply of the storage tank, the cabinet further including a flash off station whereby a supply drum remains in the cabinet from the time it is connected for having its contents pumped into the storage tank until it is finally completely emptied by flashing off any residual catalyst into an exhaust duct leading from the cabinet and forming part of the factory air scrubber system.

Yet another object is to provide a heat exchanger coupled in the catalyst handling system for maintaining the catalyst cool and thus in its liquid state so as to prevent the catalyst supply pump from becoming vapor locked.

These and other objects, features and advantages of the present invention will become apparent to those skilled in the art from the description which follows and from the drawings.

BRIEF DESCRIPTION OF THE DRAWINGS

FIG. 2 is a top plan view of the cabinet of FIG. 1 with the top removed and showing only a portion of the system shown in FIG. 1.

FIG. 4 is a schematic view of the catalyst supply and cooling circuits.

DESCRIPTION OF THE PREFERRED EMBODIMENT

Figure 1:
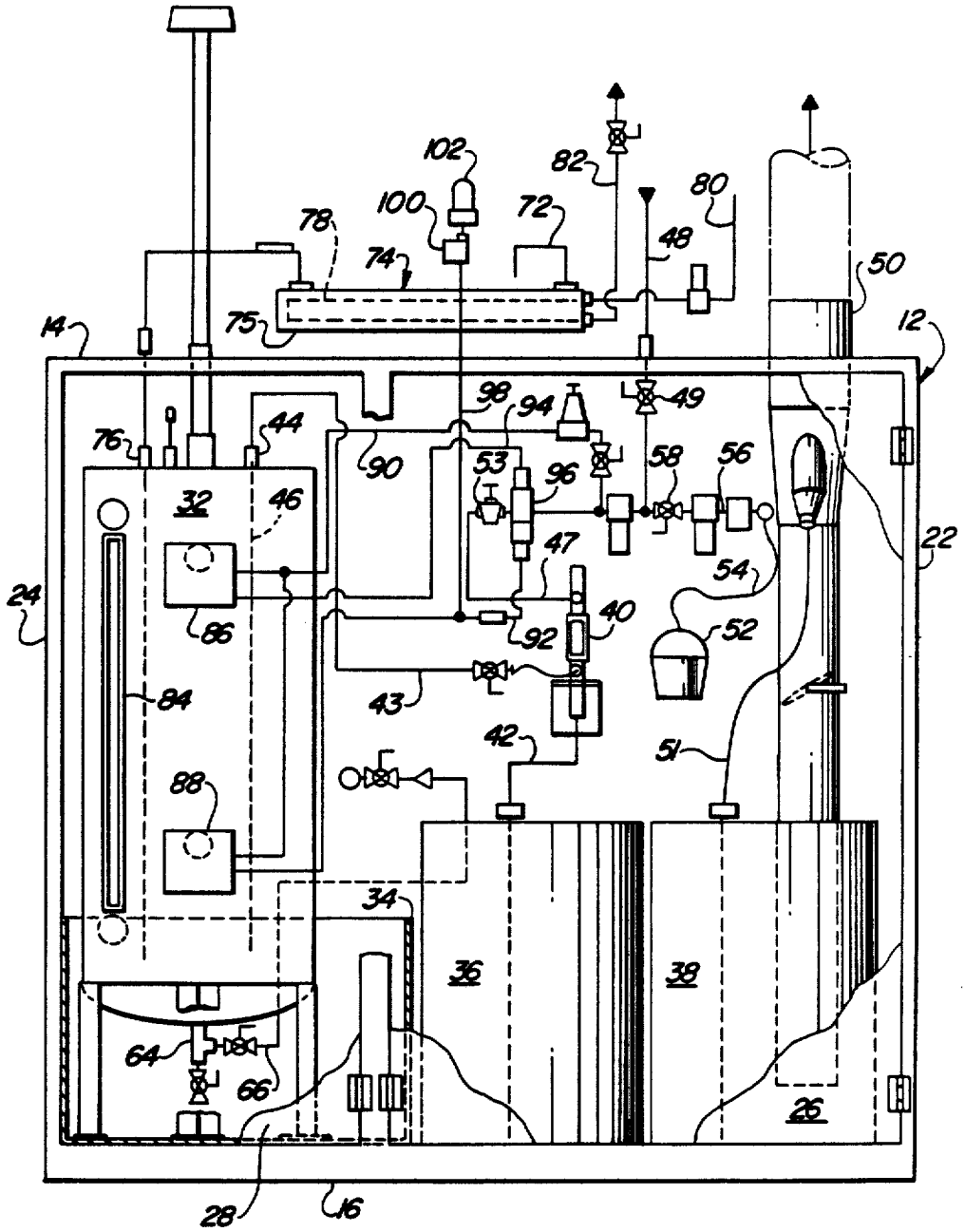
FIG. 1 is a schematic representation of the catalyst handling system forming the present invention with the cabinet, storage tank and supply drums being shown in elevation, and with a wall of the cabinet being removed to expose the components thereinside.
Figure 3:
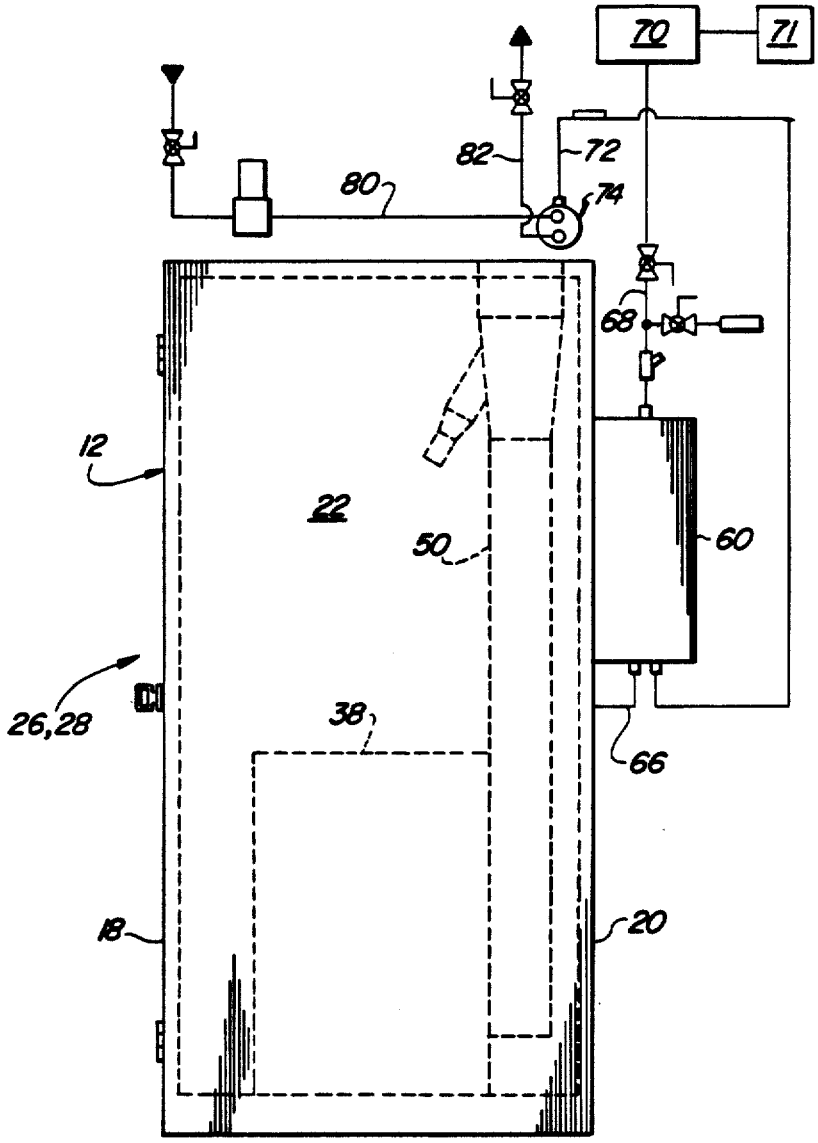
FIG. 3 is a right end view of the cabinet shown in FIG. 1 and showing the supply pump cabinet.

Referring now to the drawings, there is shown a catalyst handling system for safely and efficiently distributing or delivering liquid catalyst such as DMEA or TEA to core-making equipment. Specifically, the catalyst handling system includes a fireproof cabinet or enclosure 12 constructed of steel, for example, and having top, bottom, front, back and opposite end walls 14, 16, 18, 20, 22 and 24, respectively. As can best be seen in FIG. 2, the front wall 18 is provided with right and left double door assemblies 26 and 28, respectively, with the pair of doors of each assembly being hingedly mounted at non-adjacent ends thereof so as to leave a continuous opening when both doors are open, as illustrated, and each assembly including upper and lower lockable latches 30 for securing the doors in their closed positions.

The fireproof cabinet 12 contains a catalyst storage tank 32 located within an open-topped, fluid tight spill tank 34 positioned at the left end of the cabinet, a first catalyst supply drum 36 located at a pumping station next to the tank 34 and a second catalyst supply drum 38 located at a flash-off station at the right end of the cabinet. The drums 36 and 38 would typically be 45 or 55 gallon drums while the storage tank 32 would typically have a capacity of about 100 gallons or a capacity large enough to hold about two drums worth of catalyst.

A drum or barrel pump 40 is located adjacent the first drum 36 and has an inlet coupled to a flexible siphon hose or tube 42 shown positioned in the drum 36 with an inlet end thereof spaced closely adjacent the bottom of the drum. An outlet of the pump 40 is connected to one end of a transfer conduit 43 having its other end connected, as at an inlet coupling 44, to the top end of a pipe 46 projecting through a top wall of the storage tank and having an open lower end positioned adjacent a bottom wall of the storage tank. The pump 40 is preferably of any well known air-operated type and coupled to the pump for conveying pressurized air thereto for driving the same is a pump drive air supply line 47 which is coupled to a main line 48 serving to convey a main source of factory pressurized air. A ball valve 49 is located in the line 48 and is selectively operable for connecting air to and disconnecting air from the pump 40 so as to respectively cause and interrupt the pumping action of the pump. However, a safety cut-off valve 53 of a conventional type which is sensitive to air volume is placed in the line 47 and is set to automatically block air flow to the pump 40 when the air flow to the latter dramatically increases in response to a decrease in pumping load indicative of the condition when the drum 36 has been emptied of catalyst.

An exhaust duct 50 forms part of a factory air cleaning or scrubber system and projects downwardly through the top wall 14 of the cabinet !2 at a location adjacent the flash-off station The duct 50 has an open lower end located in spaced relationship to the bottom wall or floor !6 of the cabinet for the purpose of receiving any catalyst vapors which might be free within the cabinet, it being noted that the vapors of DMEA and TEA are both heavier than air and therefore would seek a low level within the cabinet A flexible exhaust tube 51 is located in the cabinet 12 adjacent the second catalyst supply drum or barrel 38 and has one end coupled to the exhaust duct 50. The tube 51 is inserted into the drum 38 and has an open end located adjacent the bottom of the drum for receiving the vapors of catalyst residue left in the drum after the latter has been emptied by the pump 40 and placed at the flash-off station. An air hood 52 is stored at a location on the exterior of the cabinet 12, the hood being coupled to a flexible air supply hose 54 that is coupled to a branch air line 56 containing a control valve 58 and being connected to the main air supply line 48. With the hood 52 placed over a worker's head and supplied with pressurized fresh air, the worker is able to work inside the cabinet while vapors are prevented from entering the hood thus ensuring that the worker will inhale only fresh air.

Mounted to the exterior of the back wall 20 of the cabinet 12 is a pump cabinet 60 containing a catalyst supply pump 62 having an inlet coupled to an outlet 64 at the bottom of the storage tank 32 by a conduit 66 and having an outlet coupled, as by a catalyst supply conduit 68, to a gassing or vaporizing unit 70 of core-making machine which is coupled for delivering pressurized gas to a core box 7!. Normally catalyst for the gassing units of several core-making machines will be supplied by a single pump but only one gassing unit is shown here for the sake of simplicity. A catalyst return conduit 72 couples the gassing unit 70 to a heat exchanger 74 which in turn is connected to the top of an inlet pipe 76 which projects through the top wall of the storage tank 32 and has an open lower end located adjacent the bottom of the tank. The heat exchanger 74 is preferably of a shell and tube, water-cooled type with a shell 75 thereof being the part connected to the return conduit 72 and inlet pipe 74 and with a U-bent tube 78 thereof having one end connected to a fresh water supply line 80 and its other end coupled to a water drain line 82. Thus, it will be appreciated that excess catalyst supplied to the gassing unit 70 can be returned to the storage tank 32 by way of the heat exchanger 74 which cools the returned catalyst and in that way cools the catalyst remaining in the storage tank to ensure that such catalyst remains in a liquid state whereby vapor locking of the pump 62 is prevented.

Also provided for ensuring that the core-making line does not suffer delays is a sight glass arrangement 84 mounted to the storage tank 32 for indicating the level of the liquid therein. In addition to the sight glass arrangement 84, upper and lower liquid level sensors 86 and 88 of well-known design are mounted to the tank 32, the sensors 86 and 88 being parallel-connected to a sensor air supply line 90 branched from the pump drive air supply line 47 and from which return air lines 92 and 94 respectively extend to opposite ends of a control valve 96, the return air line 92 including a branch 98 connected to a pressure switch 100 which acts to turn on a light 102 indicating when the liquid level in the tank 32 falls to a low level requiring the recharging or filling of the tank 32 from a catalyst supply drum.

In operation, assuming the storage tank 32 to be empty and that no catalyst supply drums are present in the cabinet 12, a worker will remove a full catalyst supply drum from storage using a fork lift truck or the like and will position the drum adjacent the right double door assembly 26 of the cabinet. The worker will then don the air hood 52 and other protective clothing, open the door assembly 26 and place the drum inside the pumping station adjacent the spill tank containing the storage tank 32 Next the catalyst supply drum will be opened by using a wrench to remove the usual closure plug (not shown) provided in the top thereof and the drum pump siphon hose or tube 42 will then be placed in the drum. The air valve 96 will then be opened to permit pressurized air to operate the drum or barrel pump 40. When the drum is empty, the pump 40 will speed-up and the flow of operating air to the pump will be cut-off either by the automatic operation of the air flow sensitive valve or by the worker noticing such speed-up and acting to close the valve 96 to stop the pumping action. The siphon hose 42 is then withdrawn from the emptied drum which is then moved to the flash-off station where the flexible exhaust tube 51 is inserted into the drum. Once the residual catalyst has flashed off and the vapors have been removed from the drum so as to make it safe for handling, the drum is removed from the cabinet for disposal. Another full drum of catalyst can be placed at the pumping station and readied for being emptied by the barrel pump 40 at any time the pumping station is vacant.

The catalyst supply pump 62 will be operated to deliver liquid catalyst to the gassing or vaporizing unit 70 of a core-making machine whenever a core of resin coated sand is ready in the core box to be set by curing the resins by pressurizing gaseous catalyst through the core. Catalyst in excess of that required for curing a given core, or group of cores as is more usually the case, is returned to the catalyst storage tank 32 by way of the heat exchanger 74 which cools the returning catalyst and hence the catalyst present in the tank 32. This keeps the temperature of the catalyst low enough to prevent it from vaporizing and causing the pump 62 from becoming vapor locked.

What is claimed:

1. A system for delivering liquid catalyst to core-making machines, comprising: a fireproof cabinet having first, second and third floor areas arranged serially from one end to another thereof; a catalyst storage tank positioned at the first floor area and having inlet and outlet couplings; a catalyst-containing drum positioned at the second floor area; a drum pump located in the fireproof cabinet and having an outlet coupled to the inlet coupling of the storage tank and an inlet coupled to a siphon hose adapted for being placed within a catalyst-containing drum positioned on the second floor area whereby the drum pump is operative for transferring catalyst from the drum to the storage tank; an exhaust duct extending through a wall of the fireproof cabinet and forming part of a scrubber means; a flexible conduit located within the fireproof cabinet and having one end coupled to the exhaust duct and an opposite end adapted for being placed within a second emptied catalyst drum, that has previously been emptied by the drum pump, for removing vapors as residual catalyst remaining in the emptied drum flashes off; a catalyst delivery pump having an inlet coupled to the storage tank outlet and having an outlet coupled to a catalyst supply conduit adapted for connection to a gassing unit at a core-making site; a catalyst return conduit adapted for connection to the gassing unit; and a heat exchanger connected to the catalyst return conduit and to the storage tank for cooling excess catalyst returning from the gassing unit and thereby keeping cool the catalyst remaining in the storage tank.

2. The system defined in claim 1 wherein said drum pump is an air driven type; a source of pressurized air connected to the drum pump by a pump drive air supply line; and an air flow responsive valve means being connected in said air supply line and being operative in response to a predetermined increase in air flow to the drum pump, indicative of a condition where the catalyst drum located on the second floor area has been emptied of catalyst, to automatically cut-off the flow of air to the drum pump to thereby interrupt the pumping action of the latter.

3. The system defined in claim 1 and further including an air hood removably mounted to the exterior of the fireproof cabinet and adapted for being worn by a person working within the fireproof cabinet; and a flexible air supply hose coupled between a pressurized source of fresh air and the hood whereby a worker can don the hood before entering the fireproof cabinet so as to be protected from inhaling catalyst vapors while handling catalyst drums within the fireproof cabinet for example.

4. The system defined in claim 1 and further including a catalyst level sensing means mounted to the catalyst storage tank and including an indicator means for apprising a worker of the level of catalyst present in the catalyst storage tank at any time.

5. The system defined in claim 1 wherein the heat exchanger is of a shell and tube type wherein the shell is connected to the catalyst return conduit and the catalyst storage tank; a source of cool water; a water supply line connected to an inlet end of the tube of the heat exchanger and the source of cool water; and a water return line connected to an outlet end of the tube of the heat exchanger.

6. The system defined in claim 1 wherein a pump cabinet is mounted to an exterior wall of the fireproof cabinet and said catalyst delivery pump being located in the pump cabinet.

7. The system defined in claim 6 wherein said heat exchanger is also located within the pump cabinet.

* * * * *